US005737787A

United States Patent [19]

Iozef

[11] Patent Number: 5,737,787

[45] Date of Patent: Apr. 14, 1998

[54] PILLOW RADIO APPARATUS

[75] Inventor: Ilan Iozef, Rishon Lezion, Israel

[73] Assignee: Rotem Ilan B.M., Beer-Sheva, Israel

[21] Appl. No.: 786,669

[22] Filed: Jan. 21, 1997

[51] Int. Cl.[6] ..... A47G 9/00

[52] U.S. Cl. ..... 5/639; 5/645; 5/904; 381/90

[58] Field of Search ..... 5/639, 645, 904; 381/24, 188, 205, 90

[56] References Cited

U.S. PATENT DOCUMENTS

| | | | |
|---|---|---|---|
| 2,512,641 | 6/1950 | Halstead | 5/639 X |
| 4,862,438 | 8/1989 | Fry | 5/639 |
| 5,063,912 | 11/1991 | Hughes | 5/504 X |
| 5,072,429 | 12/1991 | Mair | 5/639 X |

FOREIGN PATENT DOCUMENTS

| | | | |
|---|---|---|---|
| 2113502 | 10/1981 | United Kingdom | 5/639 |

*Primary Examiner*—Michael F. Trettel
*Attorney, Agent, or Firm*—Trexler, Bushnell, Giangiorgi & Blackstone, Ltd.

[57] ABSTRACT

The present invention relates to pillow radio apparatus which comprises an ordinary pillow substantially covered by one or two sensors extending below the pressing element, e.g. the head of the child, on one or both sides of the pillow, said sensor being able to sense the force of the pressing element; the apparatus being located within a pillow case and being connected via actuating means to a receiver, the apparatus being also connected to at least one power supply unit.

The sensor may be a capacity sensor; one or two webs being located at a suitable place and comprising a conductive net; or a bag comprising air or a fluid.

The actuating means is, for example, an electronic circuit comprising a frequency oscillator; a unit which switches the oscillator on periodically; and a unit which switches the receiver on and off, which consists of a key and an optoisolator.

The pillow case advantageously comprises the story to be told.

13 Claims, 6 Drawing Sheets

PILLOW RADIO APPARATUS

The present invention relates to a pillow radio apparatus.

Very often it is desirable to have an apparatus which will calm the children down before going to sleep. As it is known, usually the parents have a lot of difficulties to persuade the children to go to sleep. One of the common solutions is to tell the child a story before it is going to sleep. However, if there is more then one child it is always a problem which story to tell and not always both parents are available. Therefore, for a long time attempts were made in order to solve this problem. Such an attempt is described and claimed in U.S. Pat. No. 5,179,747 relating to a pillow radio apparatus. However, said patent and other solutions have a lot of drawbacks such as: the child has to put its head at an accurate point on the pillow from which the tape can start working; they are composed of a lot of components and are complicated to manufacture and to use; are expensive; etc.

It has therefore been desirable to design an apparatus which overcomes the above disadvantages, i.e. should be simple to manufacture and to use, should not be too expensive and should have the required properties, i.e. will be actuated whenever the head is put on any part of the pillow.

The present invention thus consists in a pillow radio apparatus, which comprises an ordinary pillow substantially covered by one or two sensors extending below the pressing element on one or both sides of the pillow, said sensor being able to sense the force of the pressing element; the apparatus being located within a pillow case and being connected via actuating means to a receiver, the apparatus being also connected to at least one power supply unit.

A pressing element in connection with the present invention is advantageously the head of a child and the invention will be described herein accordingly. However, it is readily understood that the invention is not restricted thereto and it may be used also for a head of an adult and to any other suitable element which may press on the pillow and thus cause the sensor to operate.

A sensor in connection with the present invention may be any suitable sensor, e.g. a capacity sensor, which senses the pressure of the pressing element and in turn sends a signal to the actuating means to actuate the receiver. Such sensor may be, inter alia,:

1) two webs both of them being located on the pillow one on the other or integrated one within the other, wherein each of said web comprises a conductive net each of them being connected to suitable actuating means;
2) two webs wherein one web is located on the pillow and the other one is located below the pillow, wherein each of said webs comprises a conductive net and wherein one of said conductive nets is either connected to the ground or to suitable actuating means; and the other conductive net is connected to suitable actuating means;
3) one web being located on or below the pillow, wherein said web comprises a conductive net, said conductive net being connected to suitable actuating means; and
4) a bag comprising air or a fluid, which bag is located on or below the pillow and is connected to a suitable conductive metal serving as a switch, which metal is in turn connected to the actuating means.

In a preferred embodiment of the apparatus according to the present invention the sensor is one of the above possibilities 1–3, advantageously possibility 1.

Actuating means in connection with the present invention may be any suitable electric or electronic circuit or combinations thereof which may be caused to operate by the signal being received from the sensor and in turn actuate the receiver. Said circuit is advantageously stored in a box, preferably a small one, which may be covered by a cloth and connected to the pillow.

In the preferred embodiments according to the present invention the actuating means are suitable electronic circuits comprising:

a. a frequency oscillator;
b. a unit which switches the oscillator on periodically; and
c. a unit which switches the receiver on and off, which preferably consists of a key and an optoisolator. The optoisolator isolates unit c from the sensor and from units a and b.

When the capacity of the sensor is changed due to an external influence, the frequency of the oscillator changes. The change of the frequency of the oscillator results in switching on unit c. (On restoring the initial value of the sensor capacity the receiver is switched off.) The larger the distance between the sensors, if two sensors are present, the larger is the starting frequency.

When the sensor is as indicated in possibility 4 the actuating means are an electric circuit.

The power supply unit may be an integral part of any suitable part of the apparatus, of the actuating means or of the receiver or may be connected to either of them. The power supply unit(s) actuate directly or indirectly any part which has to be actuated by electrical or electronic means. The power supply unit may be any suitable electrical source, e.g. batteries, the general electrical net, etc.

A web in connection with the present invention may be any flexible not conducting material such as a cloth; etc.

A bag in connection with the present invention may be made from any flexible not conducting material such as a plastic material; cloth; etc.

The conductive net in connection with the present invention may be any suitable conductive net such as: an electrical net consisting of electrical wires; a conductive color net consisting of colored wires; etc.

A receiver in connection with the present invention may be any ordinary receiver as a tape player; a radio set; a portable tape player; etc. The connection to said receiver may be mono however in a preferred embodiment according to the present invention it is a stereo connection. The receiver and the actuating means may be located within the apparatus or outside thereof.

In a preferred embodiment according to the present invention the pillow case comprises the drawings of the story to be heard.

It is easily understood that it is preferred to use small parts, for example, a small portable tape player which is covered by a cloth which is connected to the pillow. However, the present invention is not restricted to such an embodiment.

It is readily understood that the apparatus according to the present invention together with the actuating means and the receiver may be sold as one unit. However, there exists the possibility to forward separate parts which may assembled by the customer. Both possibilities are within the scope of the present invention.

The present invention operates as follows:

The receiver is put in position "play".

The child can then put his head on the pillow and then the actuating means, e.g. a so-called capacity system will actuate the receiver. Whenever, the child will raise his head from the pillow the receiver will no longer operate and the story will be stopped.

For a permanent stopping of operation, the receiver must be in position "stop".

The present invention will now be illustrated with reference to the accompanying drawings, without being limited by them. Identical parts appearing in several drawings will be referenced by the same numerals. In said drawings.

Figure 1:
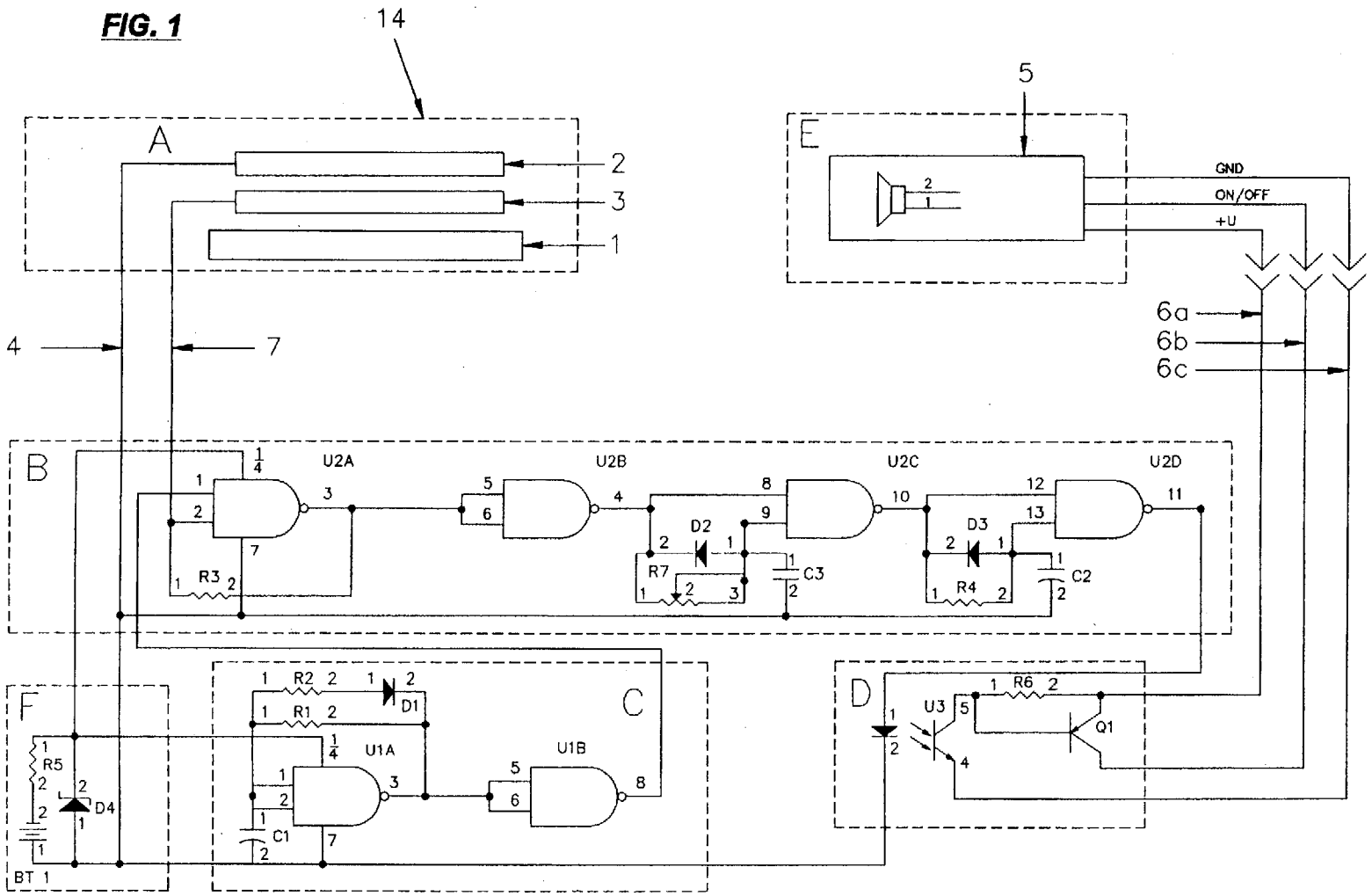
FIG. 1 shows a side view of an apparatus according to the present invention together with an electronic circuit.

In the apparatus illustrated in FIG. 1 are shown pillow 1 covered at its upper part by webs 2 and 3. Web 2 is connected by electrical wire 4 to frequency oscillator B and to power supply unit F. Said parts B and F are further connected to unit C which switches oscillator B on periodically and to unit D which switches receiver 5 on and off. Unit D is connected by electrical wires 6*a*, 6*b*, and 6*c* to receiver 5. Web 3 is connected to oscillator B by electrical wire 7.

Figure 2:
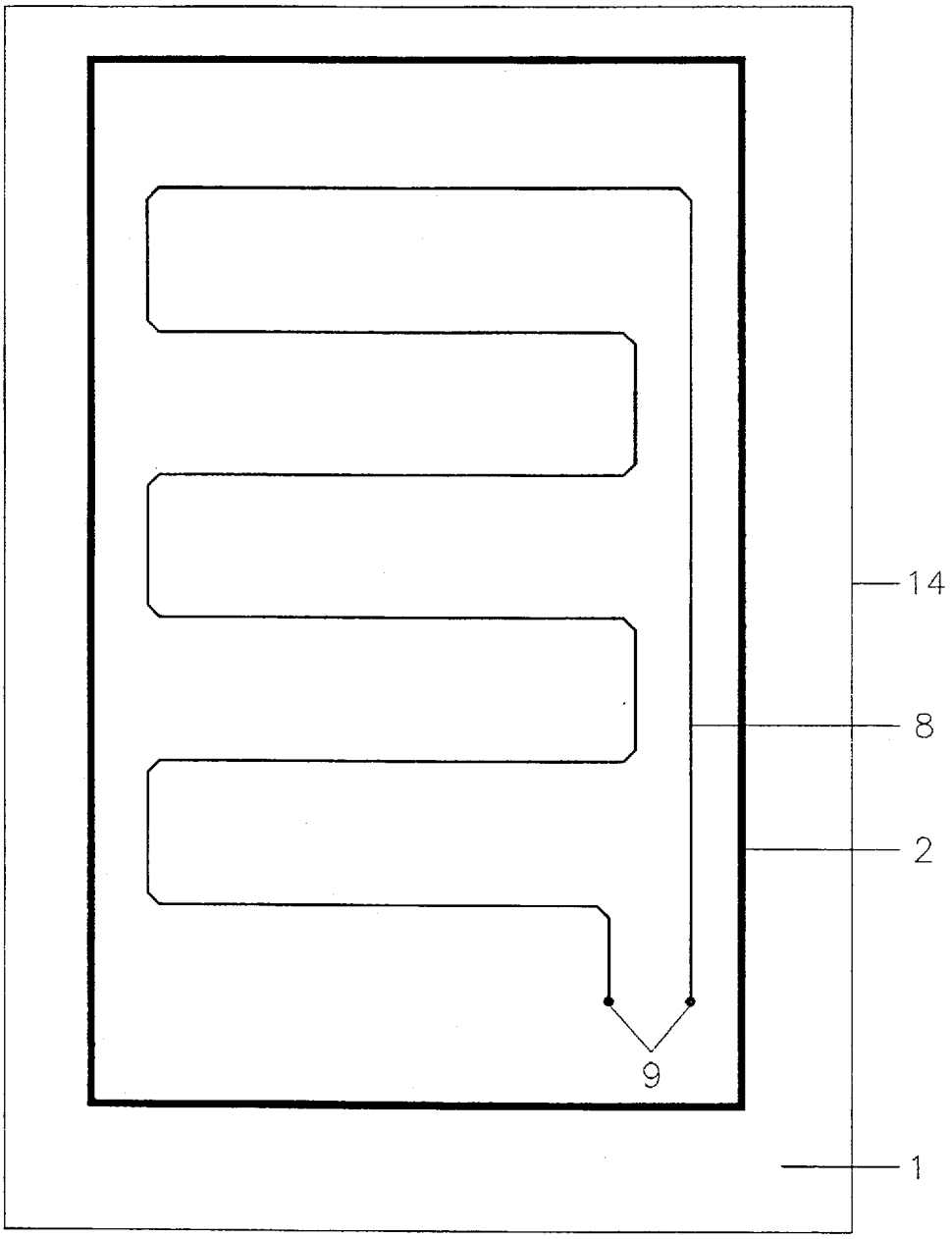
FIG. 2 shows the upper web of detail A of FIG. 1.

In the upper part of detail A of the apparatus illustrated in FIG. 1, shown in FIG. 2 are shown the upper side of pillow 1 covered by webs 2 and 3 (not seen). Web 2 comprises electric wires net 8 and exit 9.

Figure 3:
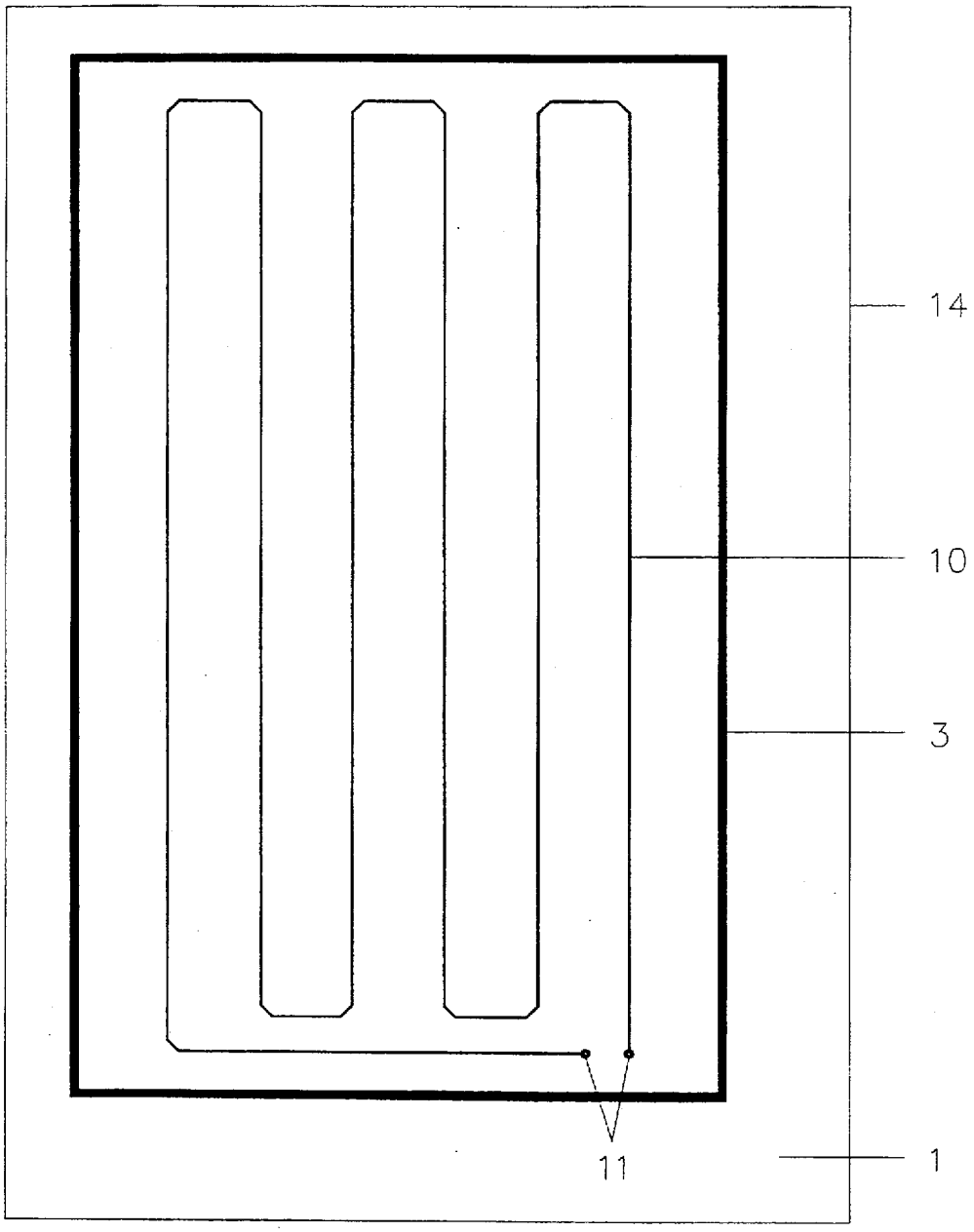
FIG. 3 shows the lower web of detail A of FIG. 1.

The lower part of detail A in FIG. 3 shows the upper side of pillow 1 covered at its upper side by web 3. Web 3 comprises electric wires net 10 and exit 11.

Figure 4:
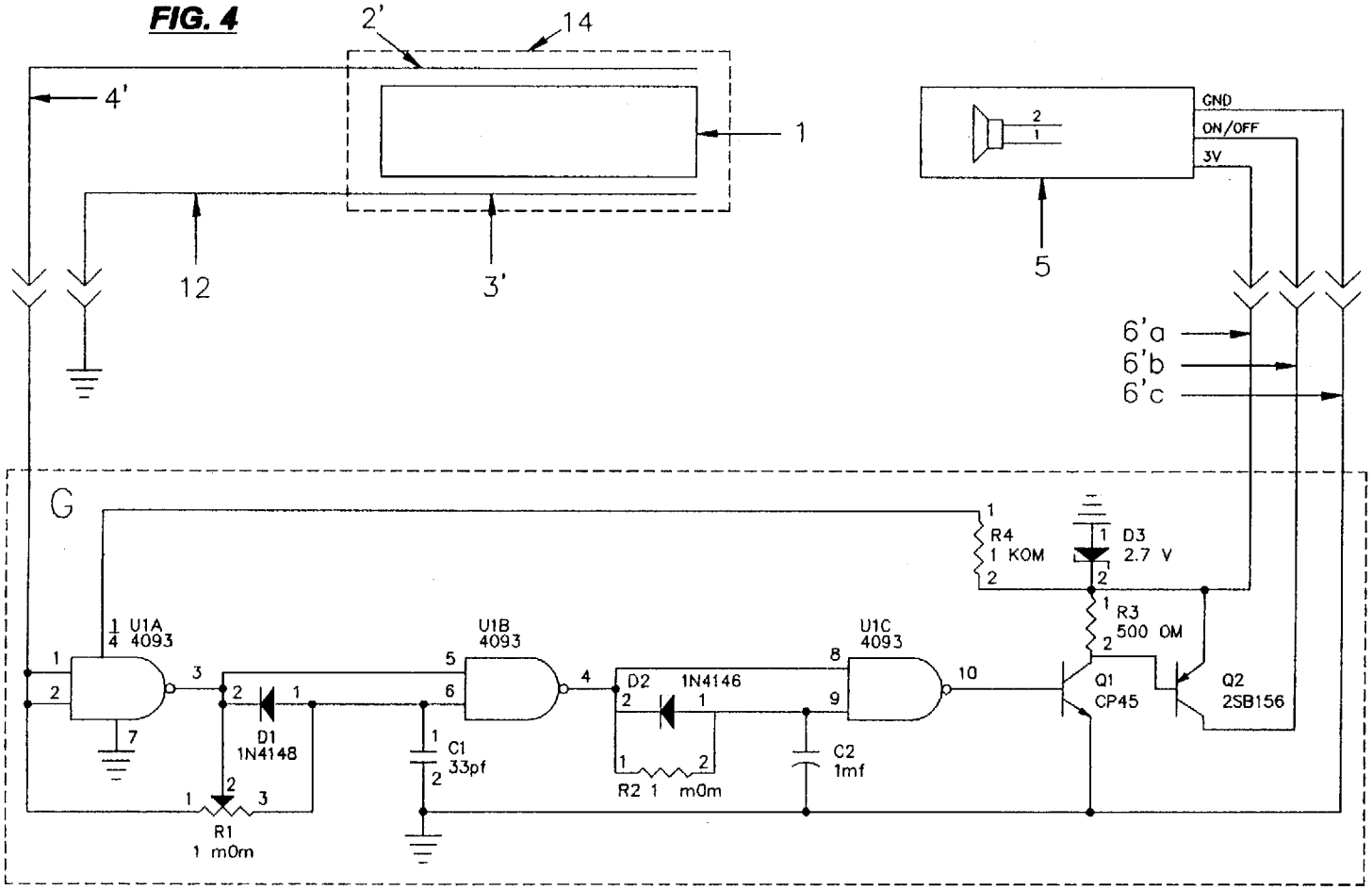
FIG. 4 shows a side view of another apparatus according to the present invention together with an electronic circuit.

In the apparatus illustrated in FIG. 4 are shown pillow 1 covered at its upper side by web 2' and at its lower side by web 3'. Web 2' is connected by electrical wire 4' to electronic circuit unit G. Electronic circuit G is connected by electrical wires 6'*a*, 6'*b*, and 6'*c* to receiver 5. Web 3' is connected to ground wire 12.

Figure 5:
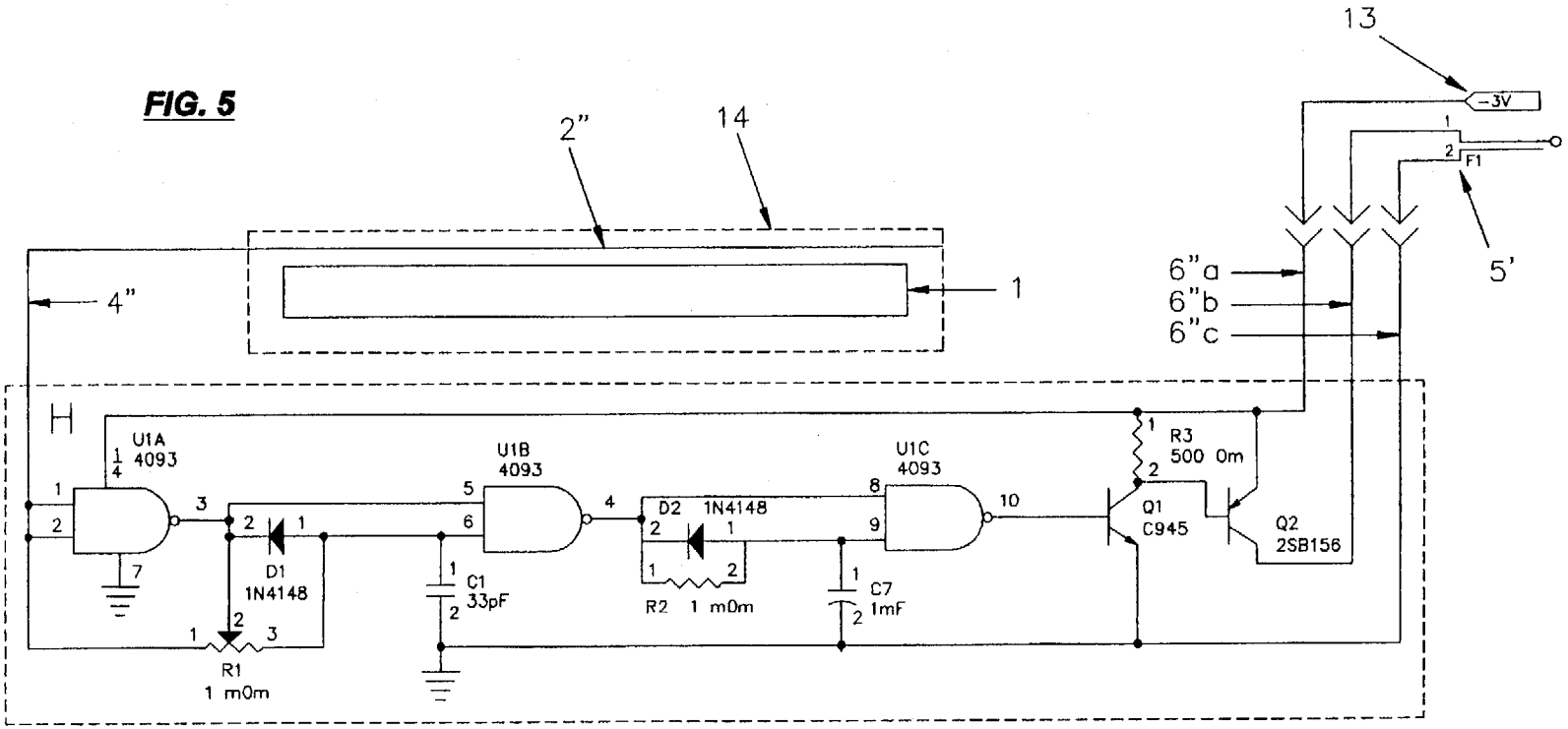
FIG. 5 shows a side view of a further apparatus according to the present invention together with an electric circuit.

FIG. 5 shows pillow 1 covered at its upper part by web 2". Web 2" is connected to electrical wire 4" which in turn is connected to electronic circuit H. Electronic circuit H is connected by electrical wire 6"*a* to battery 13 and by electrical wires 6"*b*, and 6"*c* to receiver 5'.

Pillows 1 are located within pillow case 14.

Figure 6:
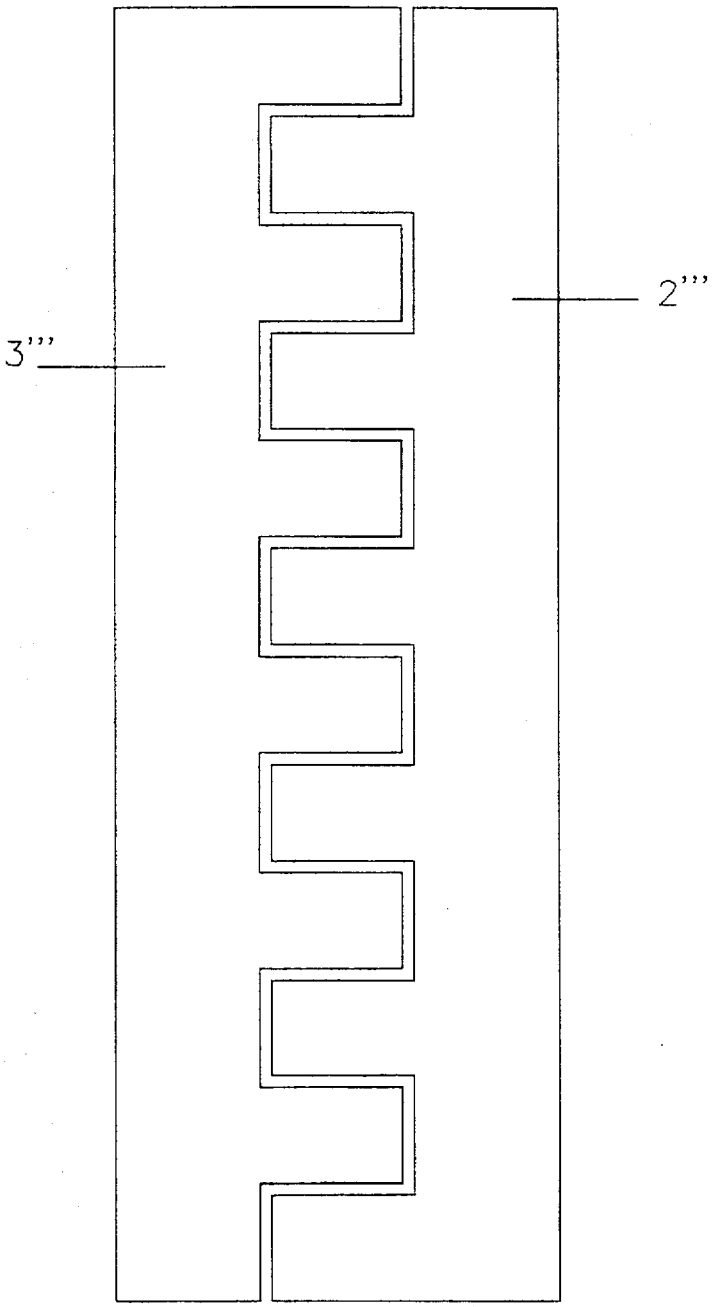
FIG. 6 shows an upper view of two webs integrated one within the other according to the present invention.

FIG. 6 shows an upper view of webs 2'" and 3'" integrated one within the other.

I claim:

1. A pillow audio apparatus, which comprises a pillow substantially covered by one or two sensors on one or both sides of the pillow, said sensor being able to sense a force applied thereto; the apparatus being located within a pillow case and being connected via actuating means to a sound emitter, the apparatus being also connected to at least one power supply unit.

2. A pillow audio apparatus according to claim 1, wherein the sensor can sense a force applied thereto by the head of a child.

3. A pillow audio apparatus according to claim 1, wherein the sensor is a capacity sensor.

4. A pillow audio apparatus according to claim 1, wherein the sensor is two webs located on the pillow one on the other or integrated one within the other, wherein each of said webs comprises a conductive net connected to the actuating means.

5. A pillow audio apparatus according to claim 1, wherein the sensor is two webs wherein one web is located on the pillow and the other one is located below the pillow, wherein each of said webs comprises a conductive net and wherein said one of said conductive nets is connected to one of ground or the actuating means; and the other conductive net is connected to the actuating means.

6. A pillow audio apparatus according to claim 1, wherein the sensor is one web located on or below the pillow, wherein said web comprises a conductive net, said conductive net being connected to the actuating means.

7. A pillow audio apparatus according to claim 1, wherein the actuating means is an electronic circuit comprising:

a. a frequency oscillator;

b. a unit which switches the oscillator on periodically; and c. a unit which switches the sound emitter on and off, which consists of a key and an optoisolator.

8. A pillow audio apparatus according to claim 1, wherein the sensor is a bag comprising air or fluid, said bag located on or below the pillow and connected to a suitable conductive metal serving as a switch and connected to the actuating means.

9. A pillow audio apparatus according to claim 1, wherein the power supply unit is connected to at least one of the actuating means and the sound emitter.

10. A pillow audio apparatus according to claim 1, wherein the sound emitter is one of a tape player or a radio set.

11. A pillow audio apparatus according to claim 1, wherein the connection to the sound emitter receiver is a stereo one.

12. A pillow audio apparatus according to claim 1, wherein the pillow case comprises indicia relating to sounds emitted from the sound emitter.

13. A pillow audio apparatus according to claim 1, wherein the sound emitter emits a story.

* * * * *